US010121295B2

(12) United States Patent
Odejerte, Jr.

(10) Patent No.: US 10,121,295 B2
(45) Date of Patent: Nov. 6, 2018

(54) SYSTEM AND METHOD FOR ACCESSING A VEHICLE

(71) Applicant: Huf North America Automotive Parts Manufacturing Corp., Milwaukee, WI (US)

(72) Inventor: Antonio Odejerte, Jr., Farmington Hills, MI (US)

(73) Assignee: Huf North America Automotive Parts Manufacturing Corp., Milwaukee, WI (US)

( * ) Notice: Subject to any disclaimer, the term of this patent is extended or adjusted under 35 U.S.C. 154(b) by 0 days.

(21) Appl. No.: 15/250,138

(22) Filed: Aug. 29, 2016

(65) Prior Publication Data

US 2017/0061714 A1 Mar. 2, 2017

Related U.S. Application Data

(60) Provisional application No. 62/212,276, filed on Aug. 31, 2015.

(51) Int. Cl.
*G05B 19/00* (2006.01)
*G07C 9/00* (2006.01)

(52) U.S. Cl.
CPC ..... *G07C 9/00079* (2013.01); *G07C 9/00309* (2013.01); *G07C 9/00571* (2013.01); *G07C 2009/00587* (2013.01); *G07C 2009/00603* (2013.01); *G07C 2009/00769* (2013.01)

(58) Field of Classification Search
CPC ..... G07C 9/00079; G07C 9/00309; G07C 2009/00769
USPC ..... 340/5.61, 5.62, 5.22, 5.64, 870.01; 370/9.1, 252, 329
See application file for complete search history.

(56) References Cited

U.S. PATENT DOCUMENTS 9,544,853 B1 * 1/2017 Gu ..... H04W 52/0261
2004/0098629 A1 * 5/2004 Khan ..... G06F 1/28 713/300
2008/0012684 A1 1/2008 Fawcett et al.
2009/0096576 A1 * 4/2009 Oman ..... G07C 5/008 340/5.62
2011/0260831 A1 * 10/2011 Ieda ..... B60R 25/246 340/5.64

(Continued)

FOREIGN PATENT DOCUMENTS

EP 0922823 A2 6/1999
EP 2048627 A2 4/2009

(Continued)

OTHER PUBLICATIONS

European Patent Office, Communication pursuant to Rule 69 EPC and Extended European Search Report for EP Application No. 16186550.6, Communication dated Jul. 3, 2017.

*Primary Examiner* — Dhaval Patel
(74) *Attorney, Agent, or Firm* — Honigman Miller Schwartz and Cohn LLP; Matthew H. Szalach; Jonathan P. O'Brien

(57) ABSTRACT

A method for accessing a vehicle includes determining a charge level of a battery of a first vehicle access device. The method also includes creating a permission scheme for a second vehicle access device. The method further includes communicating the permission scheme to a vehicle and accessing the vehicle with the second vehicle access device.

19 Claims, 5 Drawing Sheets

(56) References Cited

U.S. PATENT DOCUMENTS

| | | | | |
|---|---|---|---|---|
| 2014/0121860 | A1 | 5/2014 | Leale | |
| 2016/0016474 | A1* | 1/2016 | McCoy | B60L 1/00 307/9.1 |
| 2016/0055699 | A1* | 2/2016 | Vincenti | G07C 9/00309 340/5.61 |
| 2016/0225203 | A1* | 8/2016 | Asmar | G07C 9/00309 |
| 2016/0340940 | A1* | 11/2016 | Krishnan | E05B 81/86 |

FOREIGN PATENT DOCUMENTS

| | | | |
|---|---|---|---|
| EP | 2264980 | A1 | 12/2010 |
| WO | WO-2015103204 | A1 | 7/2015 |

* cited by examiner

SYSTEM AND METHOD FOR ACCESSING A VEHICLE

CROSS REFERENCE TO RELATED APPLICATIONS

This application claims priority U.S. Provisional Patent Application No. 62/212,276, filed Aug. 31, 2015, the entire contents of which are incorporated herein by reference.

FIELD

The present disclosure relates generally to a system and method for accessing a vehicle and more particularly to a system and method for accessing a vehicle using wireless communication.

BACKGROUND

This section provides background information related to the present disclosure and is not necessarily prior art.

A vehicle may be accessed and operated by a user in various ways. In one example, a user may utilize a key to access and/or operate the vehicle. In another example, the user may utilize a wireless communication protocol (e.g., short-range radio wave communication, Wi-Fi, BLUETOOTH ®, near field communication (NFC), etc.) to access and/or operate the vehicle. For example, the operator may access and/or operate the vehicle by utilizing a wireless communication protocol controlled and powered by a key fob.

While known systems and methods for accessing a vehicle have proven acceptable for their intended use, such systems typically require a key fob that is dedicated to a particular vehicle. Such dedicated key fobs make operation of the vehicle difficult when the vehicle is operated by multiple users such as in a car-sharing program or in a fleet (i.e., police vehicles, taxi cabs, etc.).

SUMMARY

This section provides a general summary of the disclosure, and is not a comprehensive disclosure of its full scope or all of its features.

According to one aspect, the present disclosure provides a system and method for accessing a vehicle. In some implementations, the system and method may include a first vehicle access device and a second vehicle access device. The method may include communicating with a vehicle control center. The vehicle control center may include an entity responsible for granting permission to use the vehicle. For example, the end user may communicate with the vehicle control center via telephone or the internet. In this regard, the end user may request temporary access rights for the second vehicle access device. The temporary access rights may include the right and/or permission to unlock a door on the vehicle and/or to start an engine of the vehicle. The temporary access right to the vehicle by the second vehicle access device may be controlled and monitored by the vehicle. The end user may register information associated with the second vehicle access device. The end user may also set the access rights for the second vehicle access device to "temporary." The vehicle control center may send a signal to the second vehicle access device. For example, the vehicle control center may send a confirmation to the second vehicle access device that allows the end user to access the vehicle temporarily (e.g., for a limited time and/or for a limited use) using the second vehicle access device. The vehicle may receive an encrypted message about the identity of the second vehicle access device with temporary access rights and the specific privileges of the second vehicle access device. The end user may receive a confirmation communication (e.g., a text message or email) stating that the second vehicle access device has permission to access the vehicle.

The method may also include accessing the vehicle (e.g., the locking system and/or the engine) using the second vehicle access device. In some configurations, the method includes detecting the proximity of the second vehicle access device relative to the vehicle. When the proximity of the second vehicle access device is within a predetermined range, an infotainment display may activate and request the end user to input some personal information received when the end user reserved the vehicle. If the information that the end user enters into the infotainment display matches the information stored in a database, then the infotainment display may display a message stating that the engine can be started. Once the engine is started, an engine control module may automatically delete the information and/or temporary access rights related to the second vehicle access device such that the second vehicle access device cannot access the vehicle in the future.

In some implementations, the system may include a camera system on the vehicle. In some configurations, the end user may activate an input signal during a certain time window. Once the engine control module detects the input signal, it may send a message to another control module in the vehicle to inform the camera system that it needs to turn on to capture an image. The end user must look up to the camera after activating the input signal. The camera may capture the face of the end user and send the captured image to the other engine control module for facial recognition. If the stored facial data of the end user matches the captured image, the vehicle may send a signal to the end user that the vehicle is unlocked. The infotainment display may also activate once the vehicle is unlocked. The end user may be asked a series of questions to ensure the authenticity of the end user's identity before the end user is allowed to start the engine.

According to another aspect of the present disclosure, the vehicle may include a charging area on one of the vehicle doors. For example, the end user may activate the input signal by pulling a door handle on the vehicle a predetermined number of times. Once the engine control module detects the input signal, it may send a message to another control module in the vehicle to activate a charger coil on the particular door where the end user grab and pulled the door handle. The end user may place the first vehicle access device within a predetermined distance of the specific charging area on the door. Once the battery of the first vehicle access device reaches a certain charge level, the first vehicle access device may activate a built-in NFC circuit on the first vehicle access device. The first vehicle access device and the vehicle may communicate with one another to determine whether the first vehicle access device is valid and/or registered to use the vehicle. If the vehicle confirms that the first vehicle access device is registered, it may unlock the door where the end user is charging the first vehicle access device.

Once the door is unlocked, the charging coil may immediately deactivate. Once the end user is inside the vehicle, the infotainment display may be activated. The end user may be asked a series of questions to ensure the authenticity of the end user's identity before the end user is allowed to start the engine.

According to another aspect, the present disclosure provides a system and method for accessing a vehicle using a vehicle access device. The vehicle access device may include an application having a battery monitoring strategy. Once a vehicle access device is given access rights to the vehicle, the battery monitoring strategy may monitor the battery level of the vehicle access device. This battery monitoring strategy may be activated after the first engine start of the vehicle using the vehicle access device. If the vehicle access device battery level is at or below a first level, the application may communicate a first message on the application informing the end user that the battery level is below the first level. If the battery level is detected to be below a second level, the application may communicate a second message to the end user. If the end user ignores the messages, the application may place the vehicle access device in a reduced power mode state to conserve power and to ensure access to the vehicle. While in the reduced power mode, the application may continue monitoring the battery status. Once the charge level is below a third level, the application may force the first vehicle access device to shut down. This will help to ensure that the end user is able to access the vehicle using the vehicle access device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
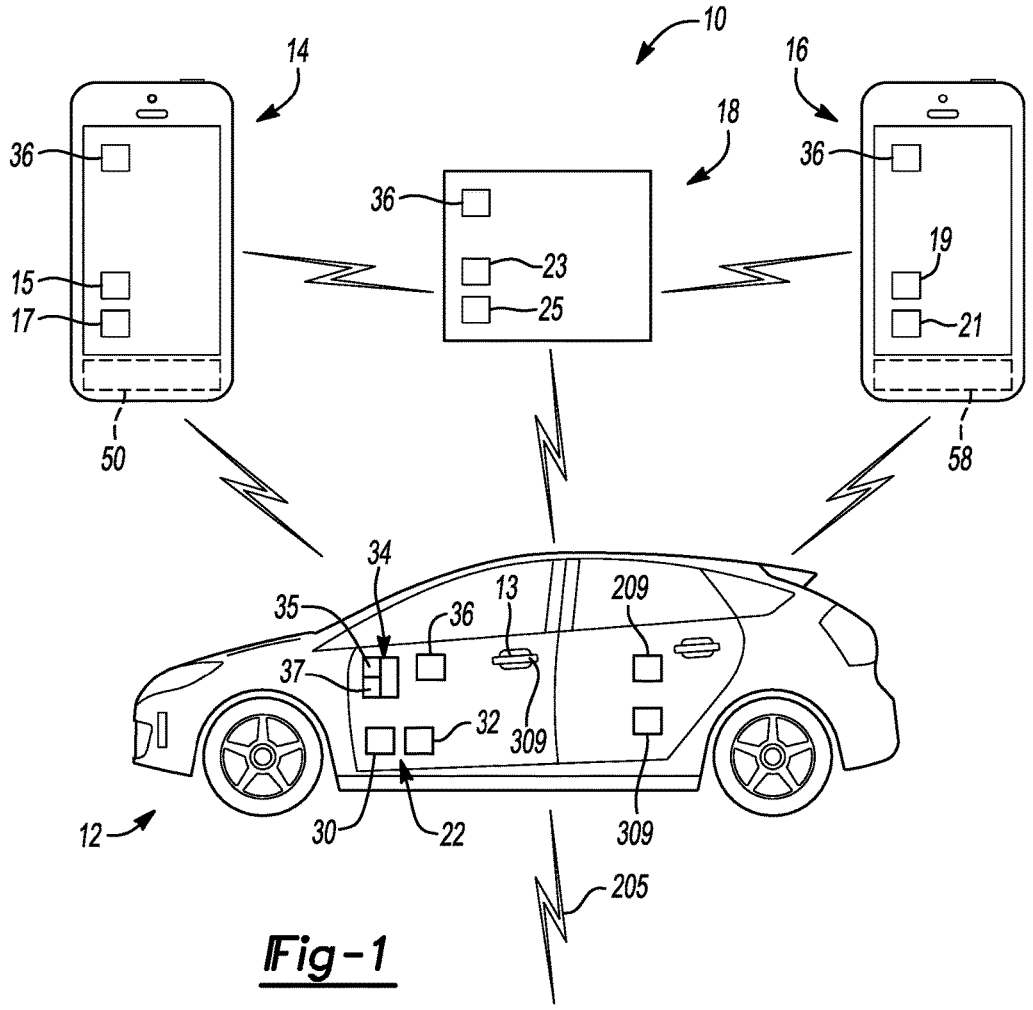
FIG. 1 is a functional block diagram of an example vehicle system according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

The description provided herein is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

With reference to FIG. 1, a vehicle access system 10 is provided. The vehicle access system 10 may include a vehicle 12, a first (e.g., primary) vehicle access device 14, a second (e.g., secondary) vehicle access device 16, and a vehicle control center 18. The vehicle 12 may be any known variety of motorized vehicle, such as a car, truck, or van, for example. In this regard, the vehicle 12 may be a private or commercial-type motor vehicle. In some configurations, the vehicle 12 may be one of a group of vehicles 12 that make up part of a fleet of vehicles, such as a fleet of rental vehicles or a fleet of commercial vehicles, such as delivery vehicles or service vehicles.

The vehicle 12 may include a locking system 20 and an engine system 22. The locking system 20 may include one or more locks 24 and a locking module 26. The locks 24 may permit and/or prevent access to the vehicle 12. For example, the vehicle 12 may further include one or more doors (not shown) and/or other access location(s). Each door and/or access location of the vehicle 12 may include a lock 24. As will be described in more detail below, the locking module 26 may communicate with the lock(s) 24 to permit and/or prevent access to the vehicle 12. For example, the locking module 26 may receive a signal from the first vehicle access device 14, the second vehicle access device 16, and/or the vehicle control center 18. The locking module 26 may control a state (e.g., locked or unlocked) of the lock(s) 24 based on the signal(s) received from the first vehicle access device 14, the second vehicle access device 16, and/or the vehicle control center 18.

The engine system 22 may include an engine 30, a starter 32, a control module 34, and a communication application 36. The engine 30 may include any known variety of engine. For example, the engine 30 may include a spark-ignition engine, a compression-ignition engine (e.g., a diesel engine), a hybrid-type engine system (e.g., an electric motor, a battery system, a generator, etc.) or an electric-type engine system. The starter 32 may communicate with the engine 30 to start, and/or otherwise provide power to, the engine 30. As will be described in more detail below, the control module 34 may communicate with and control various components of the engine system 22 and may include a processor 35 and memory 37. For example, the control module 34 may receive a signal from the locking module 26, the first vehicle access device 14, the second vehicle access device 16, and/or the vehicle control center 18. The control module 34 may control a state (e.g., allow engine start or prevent engine start) of the starter 32 and/or the engine 30 based on the signal received from the locking module 26, the first vehicle access device 14, the second vehicle access device 16, and/or the vehicle control center 18. The communication application 36 may allow the vehicle 12 to communicate with the first and second vehicle access devices 14, 16 and/or with the vehicle control center 18.

The first vehicle access device 14 may include a mobile communication device such as a smartphone, a smartwatch, or a computer (e.g., a tablet, laptop, personal digital assistant, etc.), for example and may include a processor 15 and memory 17. The first vehicle access device 14 may communicate wirelessly with the second vehicle access device 16, the vehicle control center 18, and/or the vehicle 12. For example, the first vehicle access device 14 may communicate with the second vehicle access device 16, the vehicle control center 18, and/or the vehicle 12 using any suitable wireless communication protocol such as short-range radio wave communication, WiFi, BLUETOOTH®, BLUETOOTH LOW ENERGY®, and/or near field communication (NFC), for example. In this regard, the first vehicle access device 14 may include a battery 50 and a communication application 36.

The second vehicle access device 16 may include a mobile communication device such as a smartphone, a smartwatch, or a computer (e.g., a tablet, laptop, personal digital assistant, etc.), for example and may include a processor 19 and memory 21. The second vehicle access device 16 may communicate wirelessly with the first vehicle access device 14, the vehicle control center 18, and/or the vehicle 12. For example, the second vehicle access device 16 may communicate with the first vehicle access device 14, the vehicle control center 18, and/or the vehicle 12 using any suitable wireless communication protocol such as short-range radio wave communication, WiFi, BLUETOOTH®, BLUETOOTH LOW ENERGY®, and/or near field communication (NFC), for example. In this regard, the second vehicle access device 16 may include a battery 58 and the communication application 36.

The vehicle control center 18 may communicate wirelessly with the first and second vehicle access devices 14, 16 and/or the vehicle 12 and may include a processor 23 and memory 25. For example, the vehicle control center 18 may communicate with the first and second vehicle access devices 14, 16 and/or the vehicle 12 using any suitable wireless communication protocol such as short-range radio wave communication, WiFi, BLUETOOTH®, BLUETOOTH LOW ENERGY®, and/or near field communication (NFC), for example. In this regard, the vehicle control center 18 may include the communication application 36.

Figure 2:
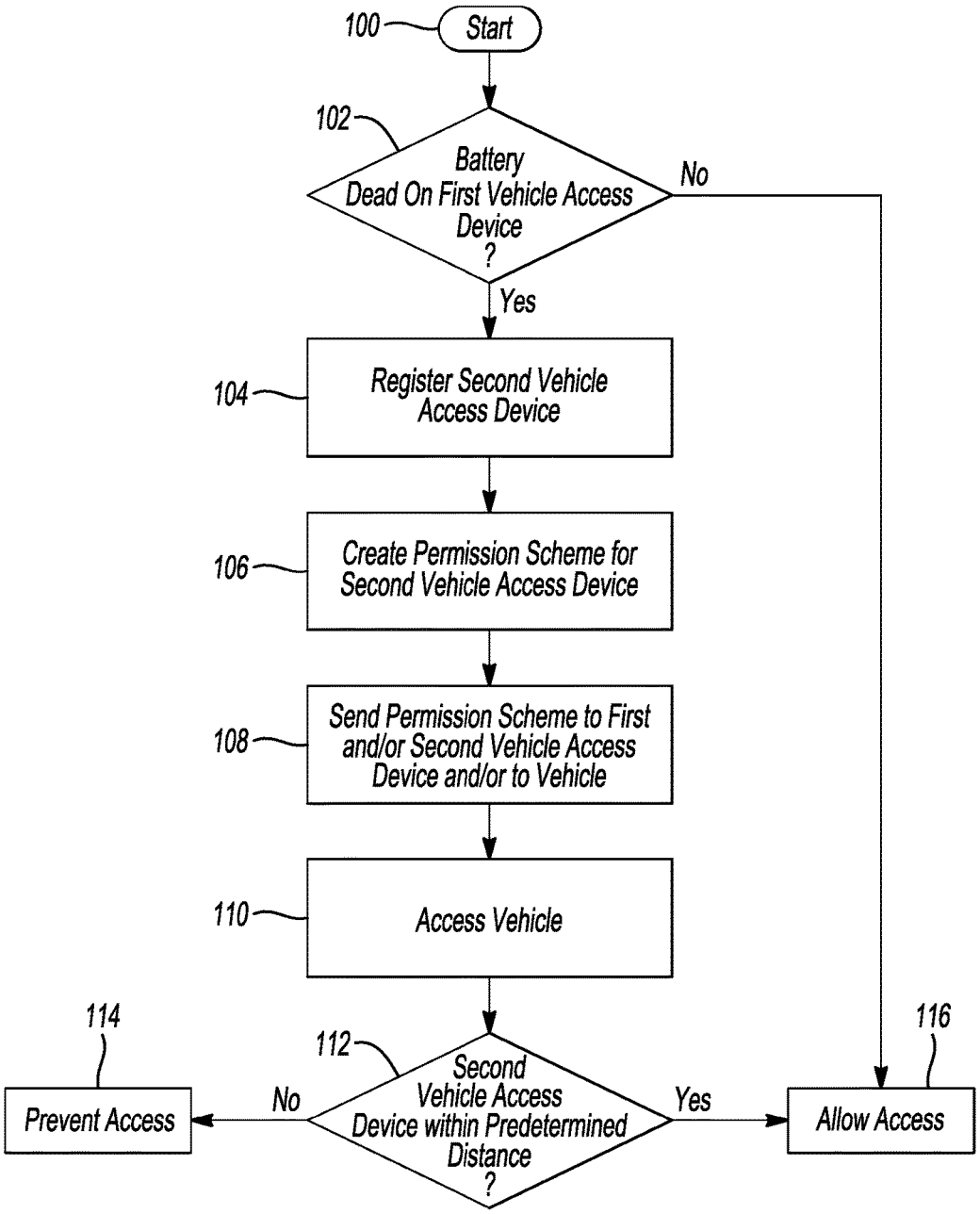
FIG. 2 is a flowchart depicting an example method of controlling a vehicle system according to the present disclosure.

With reference to FIG. 2, a method for controlling the vehicle access system 10 begins at 100. As used herein, an end user may be a party that has previously received permission to utilize the vehicle 12. For example, in one implementation, the end user may be a party that has entered into a rental agreement for the vehicle 12 with the vehicle control center 18. In other implementations, the end user may be a party that has received permission to operate the vehicle 12 as an employee or a service provider, for example. In this regard, the first vehicle access device 14 may receive a signal from the vehicle control center 18 allowing the end user to access the vehicle 12 using the first vehicle access device 14. For example, the first vehicle access device 14 may receive a signal allowing the first vehicle access device 14 to change the state of the locks 24, the engine 30, and/or the starter 32.

At 102, the method may include determining whether or not the battery 50 of the first vehicle access device 14 has sufficient power such that the end user can access the vehicle 12 using the first vehicle access device 14. For example, the end user may determine whether the battery 50 has sufficient power to allow the first vehicle access device 14 to wirelessly communicate with the vehicle 12 through the communication application 36. If 102 is true, the method may proceed to 116, where the end user may access the vehicle 12 using the first vehicle access device 14. In particular, at 116 the end user may change the state of the locks 24, the engine 30, and/or the starter 32 using the first vehicle access device 14. For example, at 116 the end user may initiate wireless communication between the first vehicle access device 14 and the vehicle 12 using the communication application 36. If 102 is false, the method may proceed to 104.

At 104, the method may include requesting permission to access the vehicle 12 using the second vehicle access device 16. In particular, the end user may contact the vehicle control center 18 to request permission to change the state of the locks 24, the engine 30, and/or the starter 32 using the second vehicle access device 16. For example, at 104 the end user may contact (e.g., phone call, website, email, text message, etc.) the vehicle control center 18 in order to register the second vehicle access device 16 with the vehicle control center 18 by providing the vehicle control center 18 with identifying information for the second vehicle access device 16. The identifying information provided at 104 may include a name, telephone number, or International Mobile Station Equipment Identity (IMEI) number of the second vehicle access device 16, for example.

At 106, the method may include creating a permission scheme for the second vehicle access device 16. In particular, at 106 the end user may communicate a desired permission scheme to the vehicle control center 18. The desired permission scheme may include an access time (e.g., a desired window and/or length of time during which the second vehicle access device 16 is permitted to the access the vehicle 12) and/or an access type (e.g., whether the second vehicle access device 16 is permitted to change the state of the locks 24, the engine 30, and/or the starter 32).

At 108, the method may include communicating a permission scheme to the second vehicle access device 16 and/or to the vehicle 12. For example, at 108 the vehicle control center 18 may communicate an access time (e.g., a desired window and/or length of time during which the second vehicle access device 16 is permitted to the access the vehicle 12) and/or an access type (e.g., whether the second vehicle access device 16 is permitted to change the state of the locks 24, the engine 30, and/or the starter 32) to the second vehicle access device 16 and/or to the vehicle 12. The permission scheme communicated at 108 may correspond to the desired permission scheme requested at 106, and may include an encrypted message received by the second vehicle access device 16. At 108, the method may also include communicating a confirmation of the permission scheme to the first vehicle access device 14. For example, at 108 the vehicle control center 18 may communicate with the end user via text message, phone call, email, etc. to the first vehicle access device 14 in order to confirm the transmission of the permission scheme to the second vehicle access device 16.

At 110, the method may include accessing the vehicle 12 using the second vehicle access device 16. For example, at 110 the end user may change the state of the locks 24 using the second vehicle access device 16 in order to allow the end user to enter the vehicle 12. In this regard, at 110 the second vehicle access device 16 may communicate with the locking system 20, including the locking control module 26, to instruct the locking control module 26 to change the state of the locks 24. In particular, the communication application 36 associated with the second vehicle access device 16 may communicate via short-range radio wave communication, WiFi, BLUETOOTH®, BLUETOOTH LOW ENERGY®, and/or near field communication (NFC), for example, with the communication application 36 associated with the vehicle 12 to change the state of the locks 24.

At 112, the method may include determining whether the second vehicle access device 16 is within a predetermined distance of the vehicle 12. For example, at 112 the control module 34 may determine whether the second vehicle access device 16 is located within the vehicle 12 by determining the proximity of the second vehicle access device 16 relative to the control module 34. If 112 is false, the method may proceed to 114 where the control module 34 may prevent operation of the starter 32 and/or the engine 30. If 112 is true, the method may proceed to 116 where the control module 34 may allow the second vehicle access device 16 to operate and/or change the state of the starter 32 and/or the engine 30.

Figure 3:
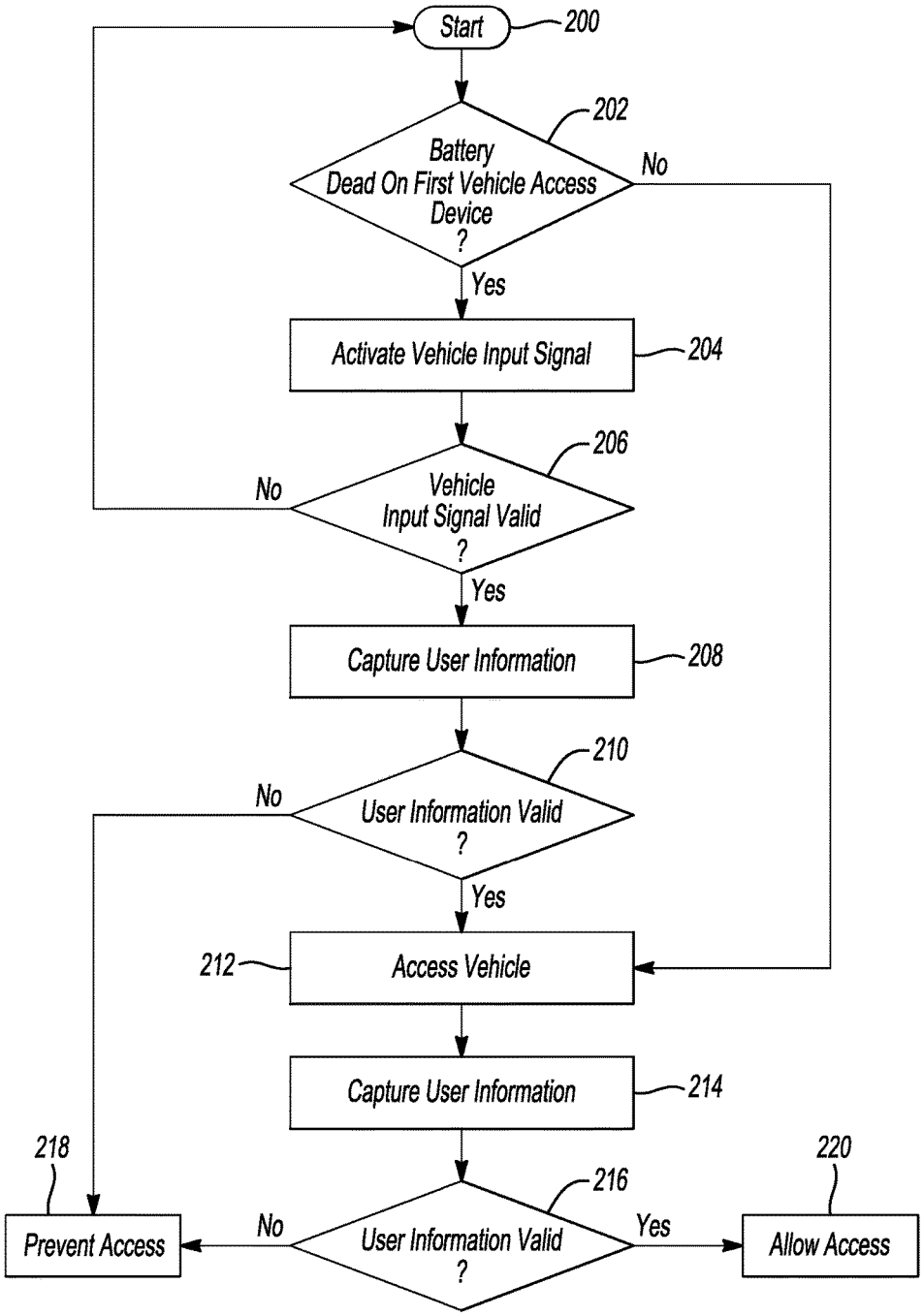
FIG. 3 is a flowchart depicting another example method of controlling a vehicle system according to the present disclosure.

Referring now to FIG. 3, another method for controlling the vehicle access system 10 begins at 200. At 202, the method may include determining whether or not the battery 50 of the first vehicle access device 14 has sufficient power such that the end user can access the vehicle 12 using the first vehicle access device 14. For example, the end user may determine whether the battery 50 has sufficient power to allow the first vehicle access device 14 to wirelessly communicate with the vehicle 12 through the communication application 36. If 202 is true, the method may proceed to 212, where the end user may access the vehicle 12 using the first vehicle access device 14. In particular, at 212 the end user may change the state of the locks 24, the engine 30, and/or the starter 32 using the first vehicle access device 14 by wirelessly communicating with the vehicle 12 using the communication application 36. If 202 is false, the method may proceed to 204.

At 204, the method may include activating and/or communicating a vehicle input signal 205 (FIG. 1) to the vehicle 12. In particular, at 204 the method may include communicating the vehicle input signal 205 to the control module 34. In this regard, the end user may activate and/or communicate the vehicle input signal 205 to the vehicle 12 by performing various actions on and/or relative to the vehicle 12. For example, the end user may activate and/or communicate the vehicle input signal 205 to the control module 34 by pulling on a door handle 13 of the vehicle 12 a certain number of times or in a certain pattern.

At 206, the method may include determining whether the vehicle input signal 205 is equal to a predetermined vehicle input signal. In particular, at 206 the control module 34 may compare the vehicle input signal 205 to the predetermined vehicle input signal. If the vehicle input signal 205 does not equal the predetermined vehicle input signal, the method may return to 200. If the vehicle input signal 205 does equal the predetermined vehicle input signal, the method may proceed to 208.

At 208, the method may include capturing one or more pieces of information from the end user to validate the identity of the user. In particular, at 208 the method may include capturing an image, fingerprint, password, or other unique identification information from the end user. For example, the vehicle 12 may further include an information capturing device 209, such as a camera, a biometric scanner, a fingerprint reader, and/or a keypad. Accordingly, in some implementations, at 208 the camera may capture an image of the end user utilizing an already existing camera associated with the vehicle 12. Namely, a back-up camera normally used to provide images to a user during operation of the vehicle 12 may be used to capture an image of the user at 208 for the purpose of obtaining information regarding the user's identity. In other implementations, at 208 the biometric scanner may capture biometric information of the end user.

At 210, the method may include determining whether the one or more pieces of information captured at 208 are equal to a stored or predetermined piece(s) of information. For example, in some implementations, at 210 the method may compare the image captured by the camera to an image of the end user stored within the vehicle access system 10. In other implementations, at 210 the method may compare the biometric information captured by the biometric scanner to biometric information of the end user stored within the vehicle access system 10. In this regard, the control module 34 may compare the information captured by the information capturing device 209 to information stored in a database on a memory (not shown) of the vehicle 12 and/or the vehicle control center 18. If 210 is false, the method may return to 200. If 210 is true, the method may proceed to 212.

At 212, the method may include accessing the vehicle 12. For example, at 212 the end user may change the state of the locks 24 using the first vehicle access device 14 in order to allow the end user to enter the vehicle 12. In this regard, at 212 the first vehicle access device 14 may communicate with the locking system 20, including the locking control module 26, to instruct the locking control module 26 to change the state of the locks 24. In particular, the communication application 36 associated with the first vehicle access device 14 may communicate via BLUETOOTH LOW ENERGY® and/or NFC, for example, with the communication application 36 associated with the vehicle 12 to change the state of the locks 24.

At 214, the method may include verifying the identity and/or location of the end user before allowing the user to control the engine 30 or starter 32. In particular, at 214 the control module 34 may capture one or more pieces of unique identification information from the end user. For example, at 214 the vehicle 12 (e.g., an infotainment display) may request the one or more pieces of unique identification information from the end user through a question and answer format with the infotainment display.

At 216, the method may include determining whether the one or more pieces of information captured at 214 are equal to a stored or predetermined piece(s) of information. For example, at 216 the method may compare the answers captured by the control module 34 to answers stored within the vehicle access system 10. In this regard, the control module 34 may compare the answer(s) captured by the control module 34 to answer(s) stored in the database on the memory of the vehicle 12 and/or the vehicle control center 18. If 216 is false, the method may proceed to 218 where the control module 34 may prevent operation of the starter 32 and/or the engine 30. If 216 is true, the method may proceed to 220 where the control module 34 may allow the end user to operate and/or change the state of the starter 32 and/or the engine 30.

Figure 4:
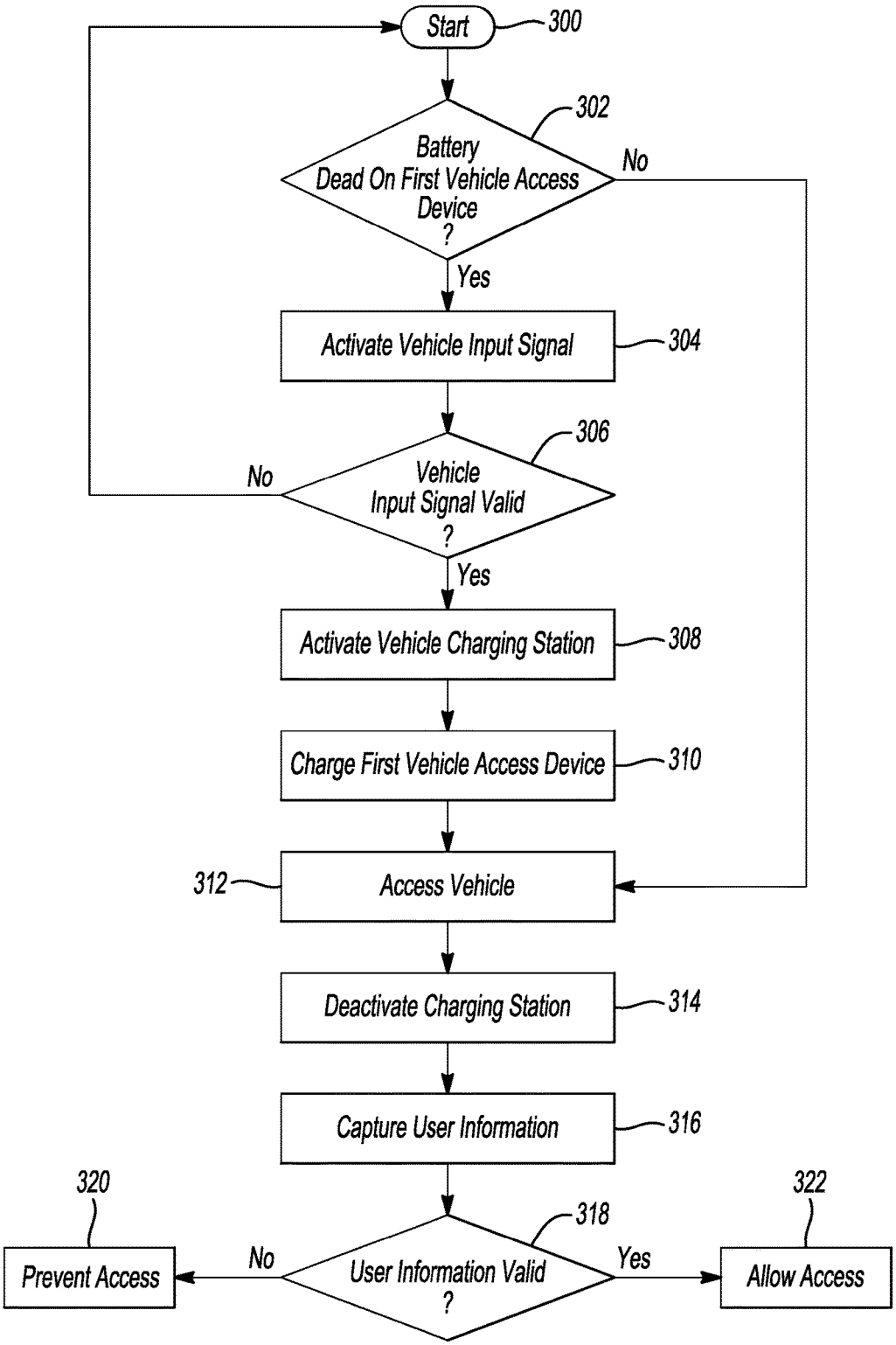
FIG. 4 is a flowchart depicting another example method of controlling a vehicle system according to the present disclosure.

Referring now to FIG. 4, another method for controlling the vehicle access system 10 begins at 300. At 302, the method may include determining whether or not the battery 50 of the first vehicle access device 14 has sufficient power such that the end user can access the vehicle 12 using the first vehicle access device 14. For example, the end user may determine whether the battery 50 has sufficient power to allow the first vehicle access device 14 to wirelessly communicate with the vehicle 12 through the communication application 36. If 302 is true, the method may proceed to 312, where the end user may access the vehicle 12 using the first vehicle access device 14. In particular, at 312 the end user may change the state of the locks 24, the engine 30, and/or the starter 32 using the first vehicle access device 14 by wirelessly communicating with the vehicle 12 using the communication application 36. If 302 is false, the method may proceed to 304.

At 304, the method may include activating and/or communicating the vehicle input signal 205 (FIG. 1) to the vehicle 12 in the manner described above. At 306, the method may include determining whether the vehicle input signal 205 is equal to a predetermined vehicle input signal. In particular, at 306 the control module 34 may compare the vehicle input signal 205 to the predetermined vehicle input signal. If the vehicle input signal 205 does not equal the predetermined vehicle input signal, the method may return to 300. If the vehicle input signal 205 does equal the predetermined vehicle input signal, the method may proceed to 308.

At 308, the method may include activating and/or providing power to a battery charging station 309. In this regard, the vehicle 12 may include the battery charging station 309 (e.g., a wired charging receptacle or wireless charging pad). At 308, the control module 34 may instruct a power source (e.g., a battery of the vehicle 12) to provide power to the battery charging station 309. The battery charging station 309 may be accessible from the exterior of the vehicle 12.

At 310, the end user may couple the first vehicle access device 14 with the charging station 309 in order to charge and/or provide power to the battery 50. In this regard, at 310 the end user may charge the battery 50 using wired or wireless communication with the charging station 309. Once the battery 50 is sufficiently charged, the method may proceed to 312 where the end user may change the state of the locks 24 using the first vehicle access device 14 in order to allow the end user to enter the vehicle 12. In this regard, at 312 the first vehicle access device 14 may communicate with the locking system 20, including the locking control module 26, to instruct the locking control module 26 to change the state of the locks 24. In particular, the communication application 36 associated with the first vehicle access device 14 may communicate via BLUETOOTH LOW ENERGY® and/or NFC, for example, with the communication application 36 associated with the vehicle 12 to change the state of the locks 24.

At 314, the method may include deactivating the charging station 309. In particular, at 314 the control module 34 may instruct the power source (e.g., the battery of the vehicle 12) to remove power from the battery charging station 309.

At 316, the method may include verifying the identity and/or location of the end user before allowing the user to control the engine 30 or starter 32. In particular, at 316 the control module 34 may capture one or more pieces of unique identification information from the end user. For example, at 316 the vehicle 12 (e.g., an infotainment display) may request the one or more pieces of unique identification information from the end user through a question and answer format with the infotainment display.

At 318, the method may include determining whether the one or more pieces of information captured at 316 are equal to a stored or predetermined piece(s) of information. For example, at 318 the method may compare the answers captured by the control module 34 to answers stored within the vehicle access system 10. In this regard, the control module 34 may compare the answer(s) captured by the control module 34 to answer(s) stored in the database on the memory of the vehicle 12 and/or the vehicle control center 18. If 318 is false, the method may proceed to 320 where the control module 34 may prevent operation of the starter 32 and/or the engine 30. If 318 is true, the method may proceed to 322 where the control module 34 may allow the end user to operate and/or change the state of the starter 32 and/or the engine 30.

Figure 5:
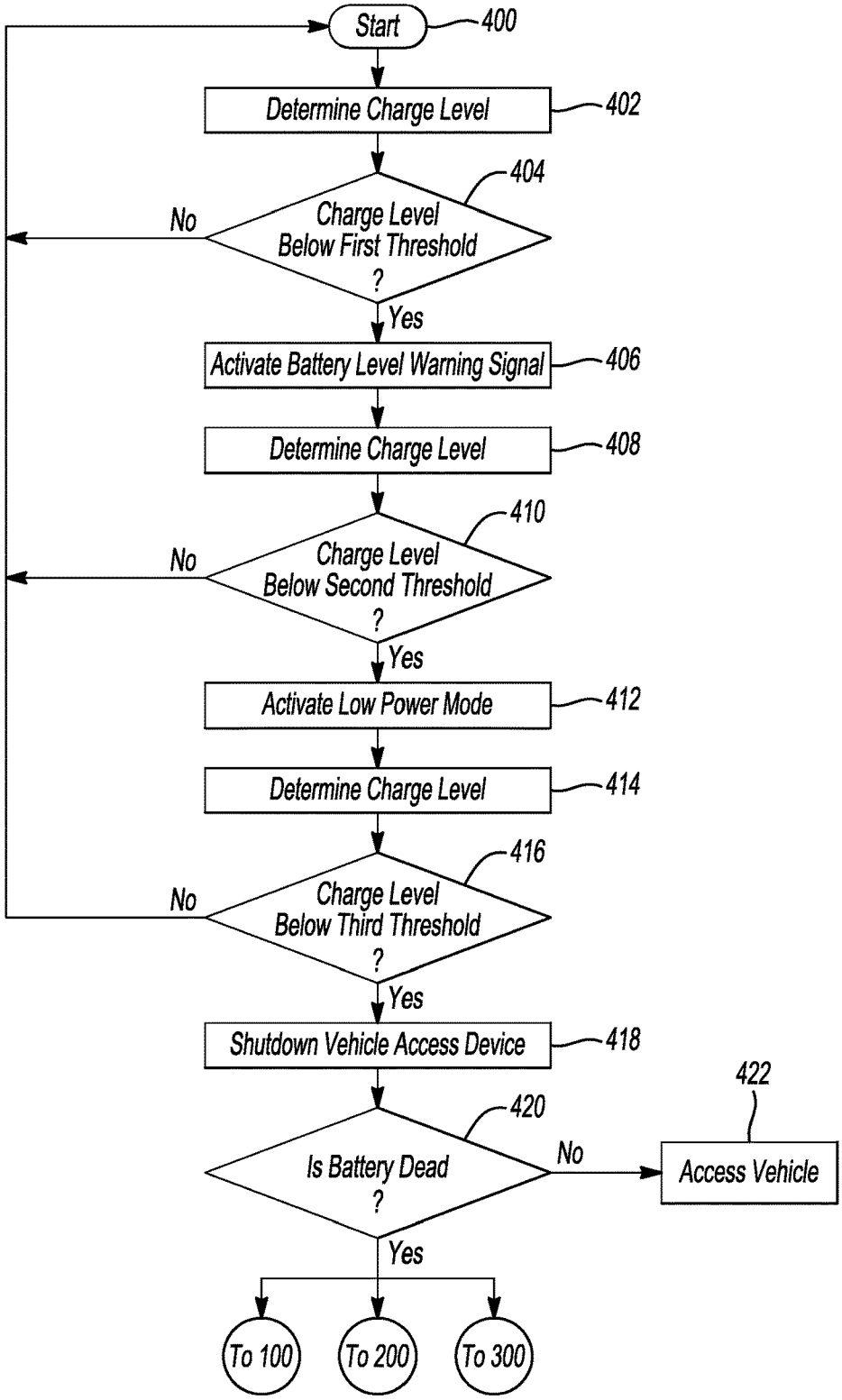
FIG. 5 is a flowchart depicting another example method of controlling a vehicle system according to the present disclosure.

Referring now to FIG. 5, another method for controlling the vehicle access system 10 begins at 400. At 402, the method may include determining a charge level of the battery 50 of the first vehicle access device 14. In particular, in some implementations, at 402 the communication application 36 may monitor the charge level of the battery 50.

At 404, the method may include determining whether the charge level of the battery 50 is below a first predetermined threshold charge level. For example, at 404 the communication application 36 may determine whether the charge level of the battery 50 is between ten and thirty percent of the full charge level of the battery 50. In some implementations, the method may determine whether the charge level is below twenty percent of the full charge level of the battery 50. If 404 is false, the method may return to 400. If 404 is true, the method may proceed to 406.

At 406, the method may include activating a first low charge level indication event. In particular, at 406 the communication application 36 may communicate the first low charge level indication event to the end user. For example, the communication application 36 may communicate an audio, visual, or other sensory indication that the charge level of the battery 50 is below the first predetermined threshold charge level.

At 408, the method may include determining another charge level of the battery 50 of the first vehicle access device 14. In particular, in some implementations, at 408 the communication application 36 may monitor the charge level of the battery 50.

At 410, the method may include determining whether the charge level of the battery 50 is below a second predetermined threshold charge level. For example, at 410 the communication application 36 may determine whether the charge level of the battery 50 is between five and ten percent of the full charge level of the battery 50. In some implementations, the method may determine whether the charge level is below ten percent of the full charge level of the battery 50. If 410 is false, the method may return to 400. If 410 is true, the method may proceed to 412.

At 412, the method may include activating a second low charge level indication event. In particular, at 406 the communication application 36 may communicate the second low charge level indication event to the end user. For example, the communication application 36 may communicate an audio, visual, or other sensory indication that the charge level of the battery 50 is below the second predetermined threshold charge level. In some implementations, the second low charge level indication event may include activating a reduced power mode of the first vehicle access device 14. For example, at 412 the communication application 36 may instruct the first vehicle access device 14 to enter the reduced power mode in order to reduce the consumption of power from the battery 50.

At 414, the method may include determining another charge level of the battery 50 of the first vehicle access device 14. In particular, in some implementations, at 414 the communication application 36 may monitor the charge level of the battery 50.

At 416, the method may include determining whether the charge level of the battery 50 is below a third predetermined threshold charge level. For example, at 416 the communication application 36 may determine whether the charge level of the battery 50 is between one and five percent of the full charge level of the battery 50. In some implementations, the method may determine whether the charge level is below two percent of the full charge level of the battery 50. If 416 is false, the method may return to 400. If 416 is true, the method may proceed to 418.

At 418, the method may include activating a third low charge level indication event. In particular, at 418 the communication application 36 may communicate the third low charge level indication event to the end user. For example, the communication application 36 may communicate an audio, visual, or other sensory indication that the charge level of the battery 50 is below the third predetermined threshold charge level. In some implementations, the third low charge level indication event may include shutting down the first vehicle access device 14. For example, at 418 the communication application 36 may prevent communication between the communication application 36 and the battery 50.

At 420, the method may include determining whether the charge level of the battery 50 is below a fourth predetermined threshold charge level. For example, at 420 the communication application 36 may determine whether the charge level of the battery 50 is zero (e.g., the battery is dead). If 420 is false, the method may proceed to 422 where the control module 34 may allow the end user to operate and/or change the state of the locks 24, the starter 32, and/or the engine 30. If 420 is false, the method may proceed to 100, 200, or 300 of the methods illustrated in FIGS. 2, 3, and 4, respectively.

The following Clauses provide an exemplary configuration for a method for accessing a vehicle described above.

Clause 1: A method for accessing a vehicle, the method comprising determining a charge level of a battery of a first vehicle access device and creating a permission scheme for a second vehicle access device and communicating by a controller the permission scheme to a vehicle controller and accessing the vehicle with the second vehicle access device.

Clause 2: The method of Clause 1, further comprising communicating by the controller the permission scheme to the second vehicle access device.

Clause 3: The method of Clause 1, wherein determining a charge level of a battery of a first vehicle access device includes determining the charge level of a smartphone, a smartwatch, or a computer.

Clause 4: The method of Clause 1, wherein accessing the vehicle with the second vehicle access device includes accessing the vehicle using a smartphone, a smartwatch, or a computer.

Clause 5: The method of Clause 1, further comprising determining by the vehicle controller a position of the second vehicle access device relative to the vehicle.

Clause 6: The method of Clause 1, further comprising capturing by an information capturing device user information.

Clause 7: The method of Clause 6, wherein capturing user information includes using a camera associated with the vehicle.

Clause 8: The method of Clause 7, wherein using a camera associated with the vehicle includes using a backup camera.

Clause 9: The method of Clause 1, further comprising activating by the vehicle controller a charging station.

Clause 10: The method of Clause 9, further comprising charging at least one of the first vehicle access device and the second vehicle access device at the charging station.

Clause 11: The method of Clause 10, wherein charging at least one of the first vehicle access device and the second vehicle access device at the charging station includes charging at least one of the first vehicle access device and the second vehicle access device at a door handle of the vehicle.

Clause 12: The method of Clause 10, further comprising deactivating by the vehicle controller the charging station following charging of at least one of the first vehicle access device and the second vehicle access device.

Clause 13: The method of Clause 1, further comprising activating by the first vehicle access device a battery charge level warning signal when a charge level of the first vehicle access device is at or below a first threshold value.

Clause 14: The method of Clause 13, further comprising shutting down the first vehicle access device when a charge level of the first vehicle access device is at or below a second threshold value less than the first threshold value.

Clause 15: The method of Clause 14, further comprising activating a vehicle input signal at a door handle of the vehicle and validating by the vehicle controller the vehicle input signal to permit access to the vehicle when the charge level of the first vehicle access device is at or below the second threshold value.

Clause 16: A method for accessing a vehicle, the method comprising determining a charge level of a battery of a first vehicle access device and activating by a vehicle controller a charging station associated with the vehicle when the charge level of the battery of the first vehicle access device is below a threshold value and charging the first vehicle access device at the charging station and accessing the vehicle with the first vehicle access device.

Clause 17: The method of Clause 16, wherein charging the first vehicle access device at the charging station includes charging the first vehicle access device at a door handle of the vehicle.

Clause 18: The method of Clause 17, further comprising deactivating by the vehicle controller the charging station following charging of the first vehicle access device.

Clause 19: The method of Clause 16, wherein determining a charge level of a battery of a first vehicle access device includes determining the charge level of a smartphone, a smartwatch, or a computer.

Clause 20: The method of Clause 16, further comprising activating by the first vehicle access device a battery charge level warning signal when a charge level of the first vehicle access device is at or below the threshold value.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A method for accessing a vehicle, the method comprising:

determining a charge level of a battery of a first vehicle access device;

creating a permission scheme for a second vehicle access device based on the charge level of the battery of the first vehicle access device;

communicating by a controller the permission scheme to a vehicle controller;

accessing the vehicle with the second vehicle access device;

activating a battery level warning signal of the first vehicle access device based on whether the charge level is below a first threshold value;

activating a low power mode of the battery of the first vehicle access device based on whether the charge level is below a second threshold value; and shutting down the first vehicle access device based on whether the charge level is below a third threshold value, wherein the second threshold value is less than the first threshold value, and the third threshold value is less than the second threshold value.

2. The method of claim 1, further comprising communicating by the controller the permission scheme to the second vehicle access device.

3. The method of claim 1, wherein determining a charge level of a battery of a first vehicle access device includes determining the charge level of a smartphone, a smartwatch, or a computer.

4. The method of claim 1, wherein accessing the vehicle with the second vehicle access device includes accessing the vehicle using a smartphone, a smartwatch, or a computer.

5. The method of claim 1, further comprising determining by the vehicle controller a position of the second vehicle access device relative to the vehicle.

6. The method of claim 1, further comprising capturing by an information capturing device user information.

7. The method of claim 6, wherein capturing user information includes using a camera associated with the vehicle.

8. The method of claim 7, wherein using a camera associated with the vehicle includes using a backup camera.

9. The method of claim 1, further comprising activating by the vehicle controller a charging station.

10. The method of claim 9, further comprising charging at least one of the first vehicle access device and the second vehicle access device at the charging station.

11. The method of claim 10, wherein charging at least one of the first vehicle access device and the second vehicle access device at the charging station includes charging at least one of the first vehicle access device and the second vehicle access device at a door handle of the vehicle.

12. The method of claim 10, further comprising deactivating by the vehicle controller the charging station following charging of at least one of the first vehicle access device and the second vehicle access device.

13. The method of claim 1, further comprising activating a vehicle input signal at a door handle of the vehicle and validating by the vehicle controller the vehicle input signal to permit access to the vehicle when the charge level of the first vehicle access device is at or below the second threshold value.

14. A method for accessing a vehicle, the method comprising:

determining a charge level of a battery of a first vehicle access device;

activating by a vehicle controller a charging station associated with the vehicle based on whether the charge level of the battery of the first vehicle access device is below a first threshold value;

charging the first vehicle access device at the charging station;

accessing the vehicle with the first vehicle access device;

deactivating the charging station with the vehicle controller;

receiving, at the vehicle controller, information associated with a user of the first vehicle access device after deactivating the charging station; and determining whether the information associated with the user of the first vehicle access device matches a stored information.

15. The method of claim 14, wherein charging the first vehicle access device at the charging station includes charging the first vehicle access device at a door handle of the vehicle.

16. The method of claim 14, wherein determining a charge level of a battery of a first vehicle access device includes determining the charge level of a smartphone, a smartwatch, or a computer.

17. The method of claim 14, further comprising activating by the first vehicle access device a battery charge level warning signal when a charge level of the first vehicle access device is at or below the first threshold value.

18. The method of claim 1, wherein the permission scheme includes at least one of an access time or an access type.

19. The method of claim 14, further comprising:

activating a battery level warning signal of the first vehicle access device based on whether the charge level is below a second threshold value;

activating a low power mode of the battery of the first vehicle access device based on whether the charge level is below a third threshold value; and shutting down the first vehicle access device based on whether the charge level is below a fourth threshold value, wherein the third threshold value is less than the second threshold value, the fourth threshold value is less than the third threshold value, and the first threshold value is less than the fourth threshold value.

* * * * *